US005231239A

United States Patent [19]

Tsumura et al.

[11] Patent Number: 5,231,239

[45] Date of Patent: Jul. 27, 1993

[54] MUSIC REPRODUCTION DEVICE FOR RESTARTING A SONG AT SELECTED POSITIONS

[75] Inventors: Mihoji Tsumura; Shinnosuke Taniguchi, both of Osaka, Japan

[73] Assignee: Ricos Co., Ltd., Osaka, Japan

[21] Appl. No.: 875,125

[22] Filed: Apr. 28, 1992

[51] Int. Cl.[5] ..... G10H 7/00

[52] U.S. Cl. ..... 84/609; 84/645

[58] Field of Search ..... 84/609-614, 84/634-638, DIG. 12, DIG. 22, 601, 602, 645

[56] References Cited

U.S. PATENT DOCUMENTS 5,009,145 4/1991 Ishida et al. ..... 84/613 X 5,101,707 4/1992 Kondo ..... 84/613

*Primary Examiner*—Stanley J. Witkowski

*Attorney, Agent, or Firm*—Thompson, Hine and Flory

[57] ABSTRACT

The invention, which assumes the use of digital music data, such as MIDI data, inserts marker codes in advance into music data at appropriate break points such that the music can then be replayed in accordance with said marker codes without sounding unnatural to the listener. If, while an output means is reading music data out of a memory means and outputting it to a sound source, the user decides he wants to replay a part of the music, he inputs a position specification by way of an operation means. A replay means then issues a replay instruction to said output means which returns to a point close to a stored marker code and outputs the music data from that point onwards. The prior insertion of marker codes into the music data at appropriate break points enables the music to be replayed from any point without arousing a feeling of unnaturalness in the listener. Moreover, by restarting the music during a replay from the point specified by the marker code immediately prior to the marker code stored in the operation means, it is possible to make allowance for a user's slowness in inputting the replay position specification into the replay means.

7 Claims, 1 Drawing Sheet

MUSIC REPRODUCTION DEVICE FOR RESTARTING A SONG AT SELECTED POSITIONS

BACKGROUND OF THE INVENTION

1. Field of the Invention

The invention relates to a repeated reproduction device of a type which could be used for the repeated reproduction of music data on, for example, a karaoke device.

2. Description of the Prior Art

Karaoke devices which store music data relating to a number of pieces of music and which read said data on request and output it to a sound source from which it is subsequently played have been known for a long time now.

There are, however, times when a person who is singing to music reproduced on this type of karaoke device may wish, perhaps in order to practice a particular part of a song, to play the corresponding part of the musical accompaniment again. In this sort of case, it has normally been necessary for the performer to simply guess the right place to restart the music and, in cases where the words of the song tell an ongoing story, for example, this can give a very unnatural feel to the performance.

SUMMARY OF THE INVENTION

The object of the present invention, which is designed for use with digital music data, such as MIDI data, is to indicate suitable break points in a stream of music by the prior insertion of marker codes, said marker codes then being used to indicate the points at which the music can be restarted without giving rise to the sort of feeling of inappropriateness that would be caused by starting the music in the wrong place.

In cases where a karaoke device is being used, however, it is not unusual for the user either to be completely engrossed in his singing or else to be somewhat light-headed and, for this reason, to make a mistake in indicating the point at which the music is to be restarted. We also therefore propose a means for the resolution of this problem as part of the present invention.

The invention, which has been designed for the attainment of the above objects, comprises a memory means which stores music data into which a plurality of identifiable marker codes have been inserted at suitable points, an output means which reads music data from said memory means and outputs it to a sound source, an operation means which is used by the user to input a replay position specification and which then stores the first marker code read out after receipt of said input, and a replay means which issues control instructions to said output means such that it accesses said operation means to ascertain the marker code which it contains and then returns to, and outputs the music data from, a point close to said marker.

This design calls for an output means first to read music data from a memory means and then to output said music data to a sound source.

In this case, when a user decides to replay part of a performance and duly inputs the replay position specification into the operation means and the replay instruction into the replay means, said replay means then issues control instructions to the output means to go back to the point closest to the point indicated by the stored marker code and to output the music data from that point on. By the prior insertion of marker codes into the music data at points at which it would be suitable to break the music, it is possible to replay music so marked without giving rise to the sort of feeling of inappropriateness that would be caused by starting the music in the wrong place.

Moreover, the marker code to which the replay means returns is always that marker code which is immediately prior to the marker code stored in the operation means.

The use of the above design means that, when a piece of music is replayed, the replay always starts from the marker code immediately prior to the marker code stored in the operation means. This in turn means that even if the user of the karaoke device is late inputting the replay position specification into the operation means, the music will nevertheless be replayed from a point close to that originally intended by the user.

DETAILED DESCRIPTION OF THE PREFERRED EMBODIMENT

Figure 1:
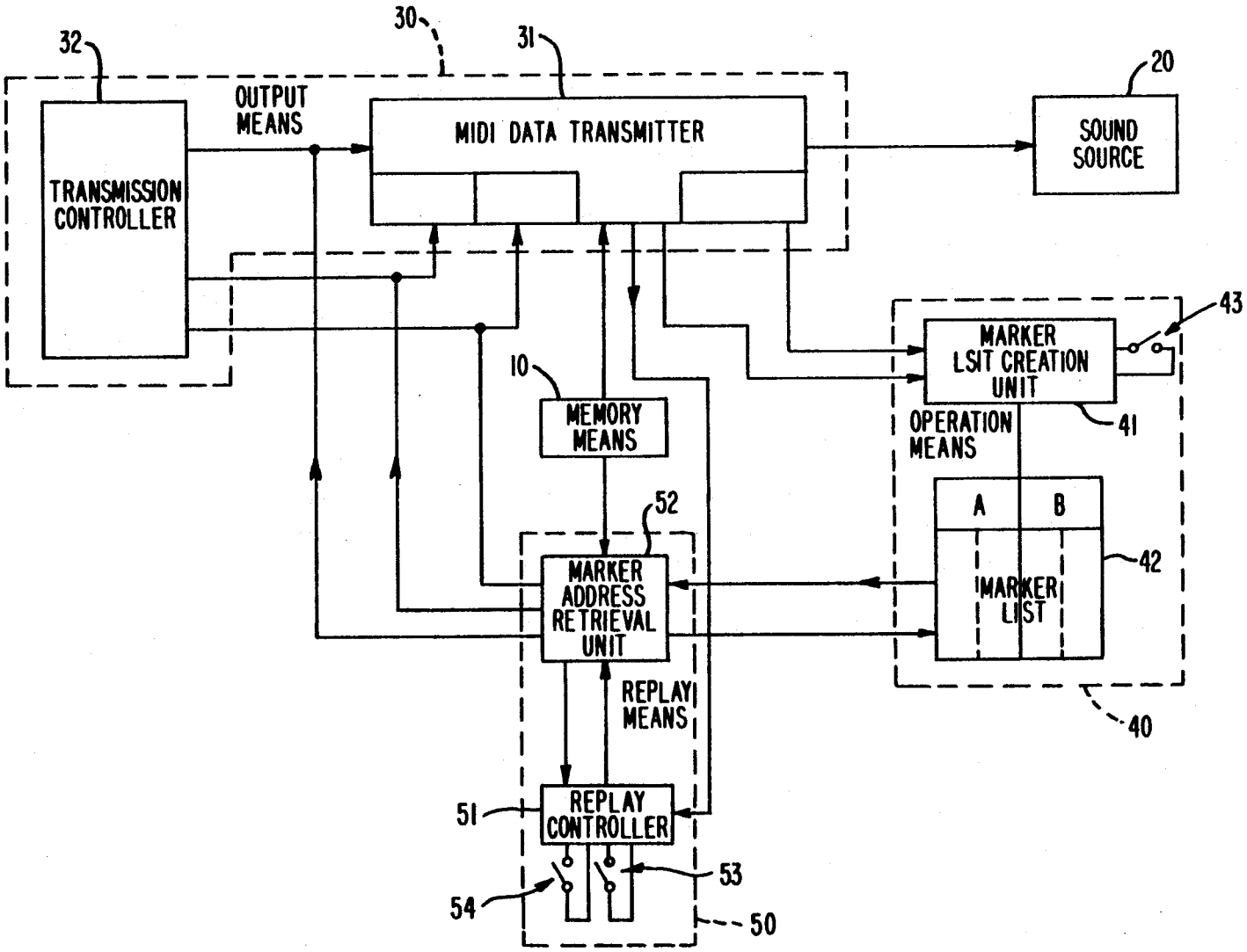
FIG. 1 is a block diagram of the preferred embodiment of the invention.

There follows a detailed description of the preferred embodiment of the invention by reference to the accompanying drawing.

FIG. 1 illustrates the preferred embodiment of a repeated reproduction device for use with a karaoke device. In FIG. 1, 10 is a memory means in which the music data relating to a plurality of pieces of music is stored. A plurality of identifiable marker codes are inserted where appropriate into said music data. Each marker code consists of an identifier, which indicates that it is a marker code, and one of a series of consecutive numbers starting with "1", which indicates the number of the marker code. Said marker codes are each inserted into the music data at suitable break points. Marker codes might, for example, be inserted into a piece of music after each bar with the proviso that, in cases where there is a meaningful lyric that goes with said piece of music, marker codes would not be inserted such that said lyric would be broken up in an inappropriate way. Said memory means 10 is able to write in new music data under instruction from a control unit which has been omitted from the drawing.

20 is a sound source for the performance of karaoke music. 30 is an output means which reads music data from said memory means 10 and outputs it to said sound source 20. Said output means 30 comprises a MIDI data transmitter 31 and a transmission controller 32 for the control of said MIDI data transmitter 31. The transmission controller 32 incorporates a function which enables it to receive requests input by the user. It then computes the start and end addresses of the requested piece of music and outputs them to the MIDI data transmitter 31 along with a transmission start signal.

The MIDI data transmitter 31 incorporates a function which enables it to read music data stored in the memory means 10, convert said data to MIDI signals and transmit it to the sound source 20. More precisely, on receipt of a transmission start signal, the MIDI data transmitter 31 reads the data from the address in the memory means 10 which has been specified as the start address and transmits it in the form of MIDI data. The transmitter 31 continues this process until it has transferred all the data up to the address specified as the end address at which point it generates a transmission end signal and ends the data transmission operation. The MIDI data transmitter 31 also has a transmission data output port which enables the monitoring of the data currently in course of transmission. While the transmission operation is in progress, the transmitter 31 generates a transmission in progress signal. 40 is an operation means which incorporates a function whereby it accepts the input of a replay position specification by the user and then saves the next marker code which is read out following receipt of said specification. Said operation means 40 comprises a marker list creation unit 41, a marker list 42 and a replay position specification switch 43. The marker list creation unit 41 incorporates a function whereby it creates the marker list 42 required for the music replay operation. More specifically, the marker list creation unit 41 is active only while the MIDI data transmitter 31 is outputting the transmission in progress signal and its function is to monitor the transmission data output port of the MIDI data transmitter 31 and, when the user depresses the replay position specification switch 43, to write the number of the next marker code found in the music data stream into the marker code list 42 as marker A. When the user finally depresses the replay position specification switch 43 again, the marker list creation unit 41 writes the number of the next marker code found in the music data stream into the marker code list 42 as marker B. From this point on, the marker list creation unit 41 continues to enter marker codes into the marker code list 42 as marker A and marker B in the manner outlined above each time the user depresses the replay position specification switch 43. In cases in which a marker B is not obtained before the end of a performance (for example, if the replay position specification switch 43 is not, in fact, depressed), the symbol indicating the final address is automatically entered in the marker B position. The marker list 42 itself is a memory area which is used to store the numbers of the markers A and B, which are required for the specification of replay positions. The data in this memory may on occasions be deleted by the marker address retrieval unit described below.

50 is a replay means which incorporates a function whereby it accepts replay specifications input by the user and then issues control instructions to the output means 30 to access the operation means 40 in order to ascertain the marker code it contains and then to go back to the point closest to said marker code and to output the music data stored from that point on. The replay means 50 comprises a replay controller 51, a marker address retrieval unit 52, a manual replay switch 53 and a replay mode switch 54. The replay controller 51, which is activated by the output of a transmission end signal, drives the marker address retrieval unit 52 in accordance with the operation mode. There are two operation modes, namely the automatic replay mode and the manual replay mode, either of which can be selected by means of a replay mode switch 54. In the case of the automatic replay mode, the replay start signal is automatically output when the transmission end signal is output. In the case of the manual replay mode, on the other hand, after the transmission end signal has been received, the replay start signal is output only when the manual replay switch 53 is depressed. The operation is subsequently terminated when the replay end signal is output from the marker address retrieval unit 52. The marker address retrieval unit 52, which is driven by replay start signals received from the replay controller 51, carries out the following operations.

(1) It reads the marker list 42 and computes the numbers of marker A' and marker B'. where the number of marker A' = (the number of marker A) − 1 and the number of marker B' = (the number of marker B) − 1

If the number either of marker A' or of marker B' comes out to zero or less then the value of that marker is set to 1. If the marker B position contains the symbol which indicates the final address, then the same symbol is also used as the number of marker B'.

(2) It accesses the memory means 10 from which it retrieves the address indicated by marker A'. In cases where there is no address at the point indicated by marker A', then replay operations relating to said marker setting are suspended and the process moves on to the replay operations relating to the next marker setting. In this sort of case, the marker setting in respect of which operations were suspended is deleted from the marker list 42.

(3) The address obtained in respect of marker A' is then set as the start address for the MIDI data transmitter 31.

(4) It accesses the memory means 10 from which it retrieves the address indicated by marker B'. In cases where there is no address at the point indicated by marker B', then replay operations relating to said marker setting are suspended and the process moves on to the replay operations relating to the next marker setting. If the address indicated by marker B' is represented by the final address symbol, then the final music data address is used as the marker B' address. In this sort of case, the marker setting in respect of which operations were suspended is deleted from the marker list 42.

(5) The address obtained in respect of marker B' is then set as the final address for the MIDI data transmitter 31.

(6) It deletes the setting of the last processed marker from the marker list 42.

(7) It sends the replay end signal to the replay controller 51.

(8) It sends the transmission end signal to the MIDI data transmitter 31.

We will now describe the operation of the repeated reproduction device of the preferred embodiment outlined above. Normally, on receipt of a transmission start signal, the MIDI data transmitter 31, operating in accordance with the request that has been input to the transmission controller 32, reads the music data stored between the specified start address and end address in the memory means 10 and outputs it to the sound source 20. When this operation has been completed, the transmission end signal is output and the performance is concluded.

If, during the course of the above, the user decides that he would like to replay a part of the music and accordingly depresses the replay position specification switch 43 at the point from which he wishes the replay to start, the first marker that is read from the stream of music data after the point at which the switch 43 was pressed is treated as marker A and its number is entered in the marker list 42 accordingly. Next, when the user presses the replay position specification switch 43 at the point at which he wishes the replay to end, the first marker that is read from the stream of music data after the point at which the switch 43 was pressed is treated as marker B and its number is entered in the marker list 42 accordingly.

When the system is in automatic replay mode, the replay controller 51 outputs the replay start signal immediately it receives the transmission end signal. When the system is in manual replay mode, on the other hand, the replay controller 51 only outputs the replay start signal when the user inputs the replay instruction by means of the manual replay switch 53. On receipt of the replay start signal, the marker address retrieval unit 52 first outputs the marker code immediately preceding the marker code indicated by marker A and the marker code immediately preceding the marker code indicated by marker B to the MIDI data transmitter as the start address and the end address respectively. The marker address retrieval unit then outputs the transmission start signal to said MIDI data transmitter 31. On receipt of said start signal, the MIDI data transmitter 31 reads the music data stored between the start address and the end address in the memory means 10 and outputs it to the sound source 20. It is thus possible, using the preferred embodiment outlined above, to insert marker codes in advance at suitable points in a stream of music data such that, when part of a performance is to be replayed, the system can return to, and output the music data from, a point close to the point indicated by the stored marker code. In practice, this means that replays can be started from points in the music which are selected specifically to avoid breaking a lyric, for example, at an inappropriate point. This relieves the reproduction of any feeling of unnaturalness that the listener might otherwise have felt.

There are, moreover, occasions when the user of a karaoke device may either be completely engrossed in his singing or else a little light-headed and may, as a result, make a mistake in inputting the replay start point. However, since the system is designed such that the actual replay is started from the position marked by the marker code which precedes the code stored in the marker list 42, the replay of the musical performance will thus be started from a point close to the point intended by the user despite the mistiming of his input of the start position with the manual replay switch 53.

What is claimed is:

1. A music reproduction device for restarting a song at selected positions comprising:

(a) memory means for storing music data into which a plurality of identifiable marker codes have been inserted in appropriate positions, said music data being MIDI data, (b) output means for reading music data from said memory means and outputs it to a sound source, (c) operation means for accepting input of replay positions insertable by a replay position specification switch and stores the first marker code which is read out after receipt of each of said replay positions, and (d) replay means for issuing control instructions to said output means such that, following the input of a replay instruction, said output means accesses said operation means for the marker code and then returns to, and outputs the music data from, a position close to that indicated by said marker code.

2. The repeated reproduction device according to claim 1 in which the marker code to which said replay means instructs said output means to return is the marker code which immediately precedes the marker code stored in said operation means.

3. The repeated reproduction device according to claim 1 in which the aforementioned marker code comprises an identifier, which indicates that it is a marker code, and a consecutive number, which indicates the number of the marker code.

4. The repeated reproduction device according to claim 1 in which the aforementioned marker codes are normally positioned at the ends of the bars of a piece of music except where this would mean positioning a marker code in an inappropriate position part way through a meaningful stretch of the lyrics.

5. The repeated reproduction device according to claim 1 in which the aforementioned output means comprises (e) a MIDI data transmitter which reads out the music data stored in the aforementioned memory means, converts said data to MIDI signals and outputs it to the aforementioned sound source, and (f) a transmission controller which accepts request input from the user and then computes the start and end addresses of the requested piece of music and outputs them to said MIDI data transmission means along with a transmission start signal.

6. The repeated reproduction device according to claim 1 in which the aforementioned operation means comprises (g) a replay position specification switch which specifies the replay position, (h) a marker list in which is stored the first marker code to be read out after the pressing of said reproduction position specification switch, and (i) a marker list creation unit which creates said marker list in accordance with the operation of said reproduction position specification switch.

7. The repeated reproduction device according to claim 1 in which the aforementioned replay means comprises (j) a marker address retrieval unit which outputs a replay end signal, (k) a replay controller which is activated by the output of a transmission end signal and which drives said marker address retrieval means in accordance with the operation mode, (l) a manual replay switch, and (m) a replay mode switch which is used to select said operation mode from either an automatic replay mode, in which a replay start signal is automatically output immediately on receipt of the transmission end signal, or else a manual replay mode, in which the replay start signal is output following receipt of the transmission end signal but only when the aforementioned manual start switch is pressed.

* * * * *